United States Patent [19]

Labie et al.

[11] 3,978,630

[45] Sept. 7, 1976

[54] CENTRAL TOWER BUILDING WITH GROUND CONSTRUCTED HOISTED AND SUPPORTED FLOORS

[75] Inventors: Allan S. Labie, New York; Irwin Paul Lew, Forest Hills; Abraham Gutman, Old Bethpage; Charles Thornton, Pleasantville, all of N.Y.

[73] Assignee: International Environmental Dynamics, Inc., New York, N.Y.

[22] Filed: Mar. 4, 1975

[21] Appl. No.: 555,312

[52] U.S. Cl. ..... 52/236; 52/73; 52/126; 52/259; 52/745

[51] Int. Cl.[2] ..... E04B 1/34; E04G 21/00; E04B 1/35

[58] Field of Search ..... 52/234, 236, 73, 126, 52/226, 227, 235, 259, 745, 747, 258, 254, 255, 256, 257, 378, 379

[56] References Cited

UNITED STATES PATENTS

| | | | |
|---|---|---|---|
| 3,017,723 | 1/1962 | Von Heidenstam | 52/236 |
| 3,036,816 | 5/1962 | Stubbs et al. | 52/126 X |
| 3,053,015 | 9/1962 | Graham | 52/126 X |
| 3,254,466 | 6/1966 | Von Heidenstam | 52/236 X |
| 3,362,126 | 1/1968 | Herolf | 52/745 |
| 3,555,763 | 1/1971 | Bloxom | 52/745 |
| 3,594,965 | 7/1971 | Saether | 52/745 |
| 3,732,655 | 5/1973 | Termohlen et al. | 52/73 |
| 3,760,542 | 9/1973 | Haeussler | 52/378 |

FOREIGN PATENTS OR APPLICATIONS

| | | | |
|---|---|---|---|
| 694,157 | 9/1964 | Canada | 52/236 |
| 74,609 | 8/1952 | Denmark | 52/236 |
| 1,168,156 | 12/1958 | France | 52/126 |
| 2,035,426 | 8/1971 | Germany | 52/227 |
| 535,106 | 10/1931 | Germany | 52/259 |
| 73,141 | 5/1970 | Germany | 52/745 |
| 1,409,923 | 5/1969 | Germany | 52/236 |
| 97,546 | 2/1961 | Norway | 52/259 |
| 809,626 | 2/1959 | United Kingdom | 52/83 |

*Primary Examiner*—Ernest R. Purser
*Assistant Examiner*—Leslie Braun
*Attorney, Agent, or Firm*—Townsend and Townsend

[57] ABSTRACT

At least one hollow core tower (preferably of a rectangular construction) is constructed from a foundation to a preselected floor supporting height. The tower is preferably joined at the top and slotted vertically along at least one sidewall from the base of the tower to a partial height of the tower. Preferably the tower is slotted along opposed sidewalls to form opposed C-shaped sections confronting one another at the slots. After at least the lowest and ground adjacent portion of the tower is constructed, floors are built about the tower at or near ground level. The floors include a section extending into or across the tower at the slot or slots which preferably includes a cantilevered or spanning horizontal floor strengthening beam. Typically, the floors are constructed and stacked one on another at their ground level with the bottom floor built first and lowest, and the top floor or roof built last and highest at the top of the ground supported stack. Floors with curtain walls preferably attached at ground level are successively raised and fastened to the tower with the top floor raised and fastened first, and the lower floor raised and fastened last. With one or more of the floors in place, each floor at or near its section adjacent the tower is fastened to the tower sides to cross brace the tower at the slot. The floor section immediately surrounds the tower and locks the opposed tower sections against outward deflection or dynamic movement. A bridge across the tower at each floor simultaneously forms an interior lobby floor having on either side building service shafts, such as those required for elevators, fire stairs and conduits.

4 Claims, 7 Drawing Figures

CENTRAL TOWER BUILDING WITH GROUND CONSTRUCTED HOISTED AND SUPPORTED FLOORS

This invention relates to buildings. More particularly, this invention relates to buildings of the type wherein a supporting tower is erected first and floors are subsequently built at the base of the tower and hoisted and fastened to the tower sides at their intended elevation to complete the building.

SUMMARY OF THE PRIOR ART

It has been known to erect a supporting central tower or core and fabricate around the base of the tower or core the floors of the building. Subsequently, these floors of the building are raised — the top floor being raised first, and the bottom floor being raised last — and thereafter fastened to the tower.

In the past, such central towers have included their own floors with openings to the peripheral floors. Thus the peripheral floors, when raised and fastened, have to come into precise registry with the floors and openings of the tower.

Moreover, the peripheral floors as fastened about the tower have heretofore not contributed to the structural strength of the tower. Rather, they have relied on the tower as an independent vertical structural member to provide the full strength for the ultimate support of the building.

Further, the openings in the floor at the tower have constituted an interruption in what would otherwise be the normal path for the placement of floor stiffening and reinforcing horizontal and longitudinal beams. As a result, expensive and elaborate paired and longitudinally extending beams on either side of the tower — preferably of steel — have been required by the prior art.

SUMMARY OF THE INVENTION

At least one hollow core tower (preferably of a rectangular construction) is constructed from a foundation to a preselected floor supporting height. The tower is preferably joined at the top and slotted vertically along at least one sidewall from the base of the tower to a partial height of the tower. Preferably the tower is slotted along opposed sidewalls to form opposed C-shaped sections confronting one another at the slots. After at least the lowest and ground adjacent portion of the tower is constructed, floors are built about the tower at or near ground level. The floors include a section extending into or across the tower at the slot or slots which preferably includes a cantilevered or spanning horizontal floor strengthening beam. Typically, the floors are constructed and stacked one on another at their ground level with the bottom floor built first and lowest, and the top floor or roof built last and highest at the top of the ground supported stack. Floors with curtain walls preferably attached at ground level are successively raised and fastened to the tower with the top floor raised and fastened first, and the lower floor raised and fastened last. With one or more of the floors in place, each floor at or near its section adjacent the tower is fastened to the tower sides to cross brace the tower at the slot. The floor section intimately surrounds the tower and locks the opposed tower sections against outward deflecting or dynamic movement. A bridge across the tower at each floor simultaneously forms an interior lobby floor having on either side building service shafts, such as those required for elevators, fire stairs and conduits.

OBJECTS AND ADVANTAGES OF THE INVENTION

An object of this invention is to construct at ground level both a building floor and a tower floor. According to this aspect, a hollow core tower is provided with at least one vertically disposed slot extending from the base of the tower to the supported height of a floor. The floor, as it is constructed around the base of the tower, extends into and defines interiorly of the tower at least a substantial portion of the tower floor. When the peripheral floor is raised and fastened, the interior floor of the tower is also raised and fastened providing simultaneously a floor peripheral to the tower as well as a floor interior of the tower.

An advantage of this aspect of the invention is that the finished structure of the central tower and the finished structure of the floor are the only structures necessary to effect construction of the building. Supported forms or supported partial braces to either the floor or the tower are not required during construction.

A further advantage of this aspect of the invention is that registry of a separate tower floor with a separate peripheral floor is not required.

A further object of this invention is to disclose a tower which has a peripheral floor surrounding the tower with a section of the peripheral floor bridging across the tower to support the tower floor. According to this aspect of the invention at least one hollow core tower is slotted preferably at opposed sidewalls from the base of the tower to at least the floor supporting height of the tower. The peripheral floor is constructed to extend into and span the tower at the slots. When the peripheral floor is raised and fastened, the spanning floor is likewise raised and fastened to provide a peripheral floor and tower floor simultaneously.

An advantage of this aspect of the invention is that the floor contributes to the overall strength of the tower. Specifically, the floor as it is fastened to the tower sidewalls cross braces the tower sidewalls at their point of juxtaposition to the slot. Thus, as the floors are raised and fastened, the tower is cross braced by the fastened floor.

Additionally, the peripheral floor surrounds the tower section which is divided by the paired slots. Movement of one tower section away from the other tower section under either static or dynamic loading is prevented. A unitary self-bracing building structure results as the floors are fastened in place.

A further advantage of the spanning floor at the tower is that the floor extends in a natural building hallway disposition. Thus, where paired towers are provided with slots opening along a common longitudinal axis of a building, these aligned slots can define the natural path for a central hallway in the building.

Yet another advantage of this aspect of the building is that the floors, as bridging the tower, tend to naturally divide the tower to define within the tower the necessary shafting for building services. For example, fire stair shafts, elevator shafts, piping shafts and the like are all naturally defined by the floor as it spans the slotted tower.

A further object of this invention is to provide in a peripheral floor a natural path for a longitudinal floor stiffening and reinforcing beam. According to this aspect of the invention, when the central tower is constructed with opposed slots, a path for a floor stiffening beam extending longitudinally of the floor and through the tower at the slot is defined. By the expedient of placing the beam in the peripheral floor along an axis coincident with the axis of the slot and raising and fastening the floor to the tower, an improved floor construction results.

An advantage of this aspect of the invention is that the floor reinforcing (consisting of a beam spanning the tower at the slot) is complementary to the tower reinforcing (the fastening of the tower adjacent the slot to the raised floor). Thus, the beam spanning the tower at the building top serves the dual function of stiffening the floor as well as tying the tower sections adjacent the slot one to another.

Another aspect of this invention is that the central beam of the floor is defined overlying the hallway of underlying complementary floors. Since heating, ventilating and air condition systems are commonly routed away from hallways, a beam overlying a hallway can readily complement heating, ventilating and air conditioning designs.

A further aspect of this invention is that a building constructed symmetrically about its supporting towers results. High resistance to dynamic building loadings is possible.

Other objects, features and advantages of this invention will become more apparent after referring to the following specification and attached drawings in which.

DESCRIPTION OF THE PREFERRED EMBODIMENT

Figure 1:
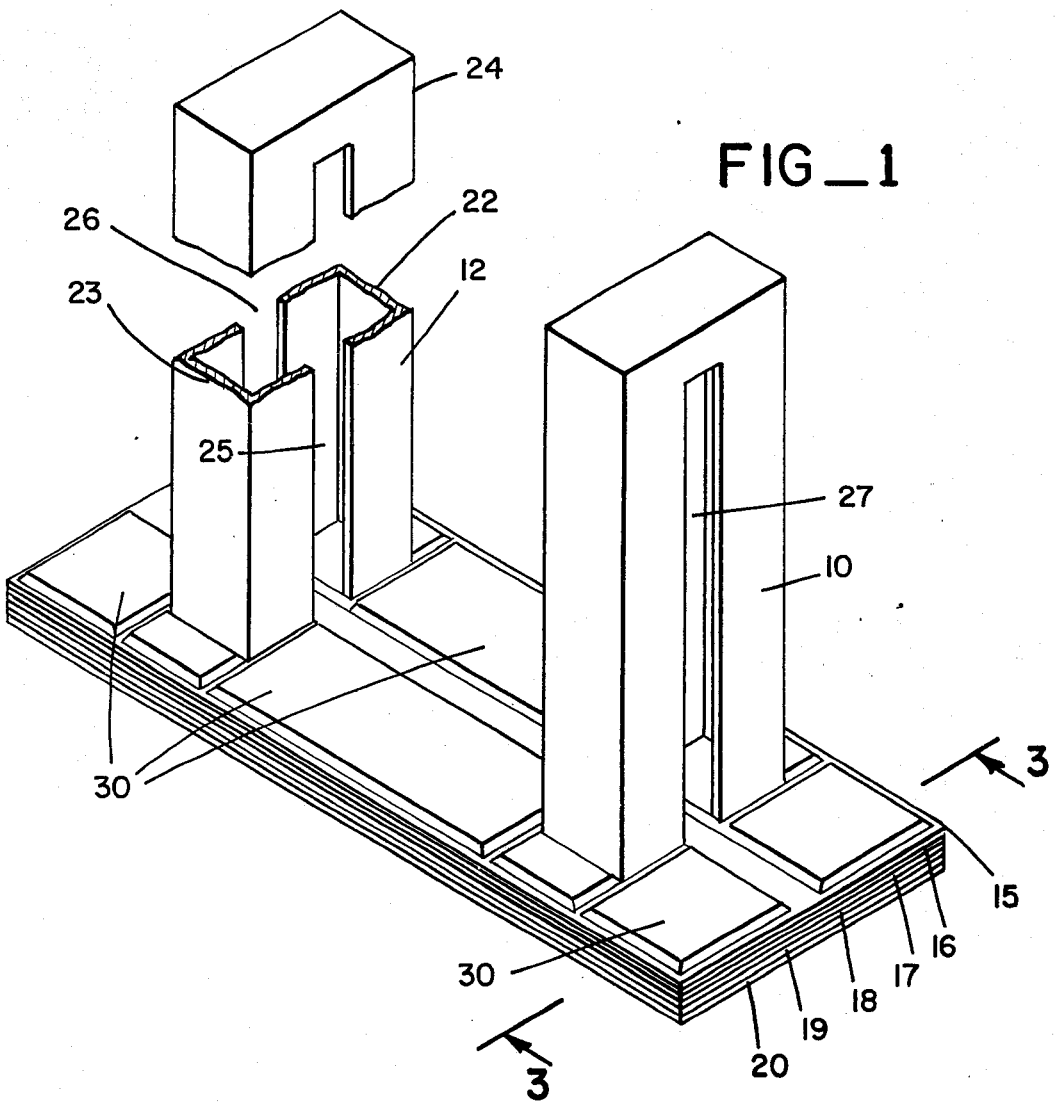
FIG. 1 is a perspective view of the building of the present invention in an intermediate stage of construction with the floor slabs constructed but not yet raised.

An intermediate stage of construction of the building of the present invention is illustrated in FIG. 1. At this stage, a pair of core towers 10, 12 has been constructed preferably by conventional reinforced concrete slip forming techniques. A stack of reinforced concrete floor slabs 15–20 has been constructed at and around the base of the respective towers. These floors 15–20 are formed with the lowest floor formed first and the upper floor formed last. It should be noted that each floor as formed serves as a support for the mold of an immediately overlying floor when it is formed.

As depicted in the broken away portion of tower 12, each tower comprises a pair of opposed C-shaped sections 22, 23, preferably joined at the top by tower roof 24. Each C-shaped section 22, 23 is comprised of three contiguous sidewalls which meet at right angles so that the two C-shaped sections in combination have a generally rectangular configuration. Slots 25, 26 are defined at opposite sides of core tower 12 and separate C-shaped segments 22, 23 of the tower. Corresponding slots 27 are formed in core tower 10, which is here shown identical to core tower 12. Slots 27 extend upwardly from adjacent the base of the core tower to the point at which the two C-shaped sections forming the tower are joined.

Figure 2:
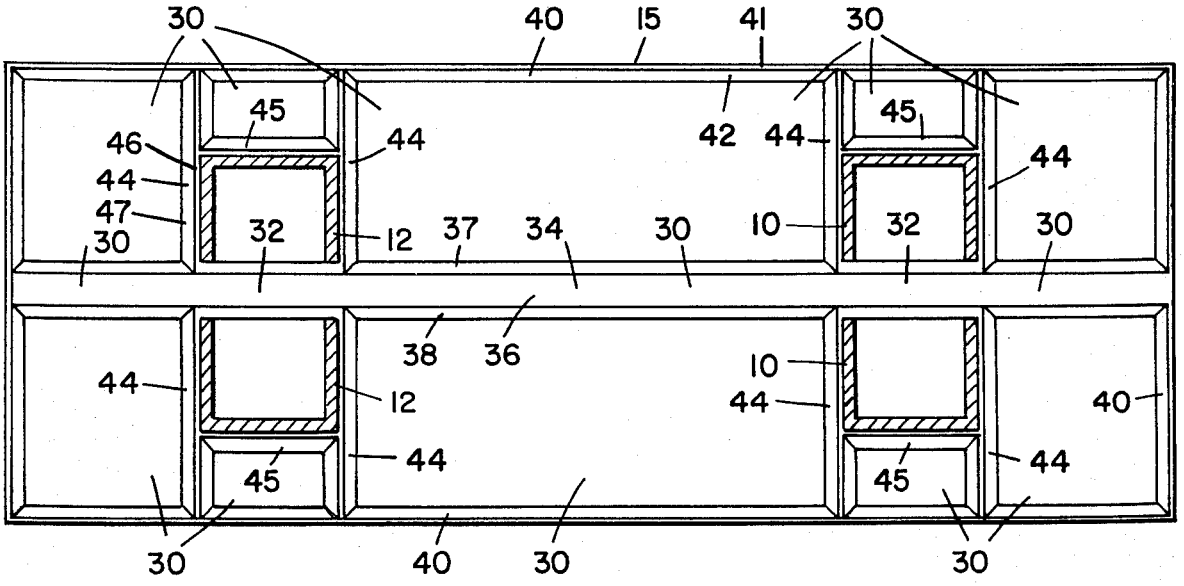
FIG. 2 is a plan view of one of the floor slabs of the present invention illustrating the core towers in section.

As illustrated by FIGS. 1 and 2, each floor slab, such as slab 15, has a major portion 30 which surrounds core towers 10, 12. In addition, secondary portions 32 contiguous to major portion 30 pass through the slots separating the confronting C-shaped segments of core towers 10, 12 to bridge the slots. It is preferred that secondary portions 32 span the spatial interval between the tower sidewalls which define the slots. As a result, floor slab 15 surrounds core towers 10, 12, bridges the core of the tower, and occupies the spatial interval between the tower walls which define the slots.

Figure 3:
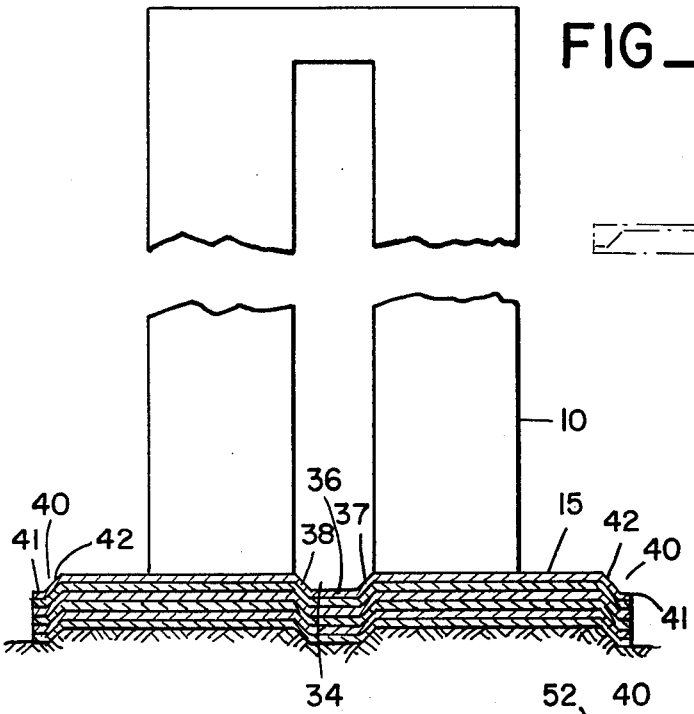
FIG. 3 is a cross sectional view taken along lines 3—3 of FIG. 1.

As is evident from viewing FIGS. 1, 2 and 3, each floor slab such as 15 has a plurality of folds formed therein, these folds forming upwardly exposed concavities. A central fold 34 traverses the length of floor slab 15 including its secondary portions 32. Central fold 34 comprises a depressed planar portion 36 and upwardly inclined side portions 37, 38 contiguous to the rest of the floor slab. A peripheral fold 40 is formed around the border of floor slab 15 and includes a depressed portion 41 and an inclined portion 42 connecting the depressed portion with the remainder of the floor slab.

Transverse folds 44 are formed on the opposite sides of the respective core towers 10, 12 and are connected by folds 45. Each fold 44, 45 includes a depressed portion 46 and an inclined side 47 joining the depressed portion to the remainder of the floor slab. As will be illustrated in more detail hereinafter, folds 34, 40, 44 and 45 provide beam paths for reinforcing and stiffening the floor slab.

As described above, a plurality of floor slabs 15–20 are formed, one on top of the other, at the base of core towers 10, 12. To avoid the necessity of providing spacers between the floors, these floor slabs are dimensioned to "nest" at the base of the core towers, as illustrated in FIG. 3. By "nesting" it is meant that the lower surface of each floor slab is conformed to the upper surface of the underlying floor slab so that no spaces or gaps exist between the floors when they are stacked on top of each other.

In order that the floors nest when they are stacked one on top of another, it is essential that the vertical dimension of each floor slab is maintained constant. This constant vertical dimension must be maintained not only along the horizontal portions of the floor slab, but along the inclined portions of the fold as well.

The true thickness of each inclined portion of the floor slabs, such as inclined sidewalls 37, 38 of central fold 34, is equal to the vertical thickness of the sidewall times the cosine of the fold angle from the major planar surface of the floor slab. It will be appreciated that if the angle of the fold is too large, insufficient thickness of the floor slab will occur at the folds. On the other hand, if the angle of the fold is too small, insufficient beam action of the folded plate construction will result. It is preferred that the fold angle of the inclined portions of the folds be approximately 45°. However, it is anticipated that the fold angle may vary from a low of 30° to a high of 60° and still achieve the objects of the present invention.

The primary advantage of having the floor slabs designed so that they "nest" is that each floor slab can serve as an underlying form for pouring of the next uppermost slab. The floor slabs can be formed one by one, and after each floor slab is allowed to cure, it provides the underlying form for pouring the next overlying floor slab, greatly reducing the time and expense of forming the floors. It is apparent that if the floors do not "nest", i.e. gaps are provided between the various parts of the floor slabs, forms or spacers would have to be inserted on each floor slab so that the next overlying floor slab can be poured, greatly complicating the process of forming the floor slabs at the base of the core towers.

It should be understood that it is an adaptation of the present invention to form the floor slabs one at a time at the base of the core towers and elevate that floor slab to its raised position prior to pouring the next floor slab.

Figure 4:
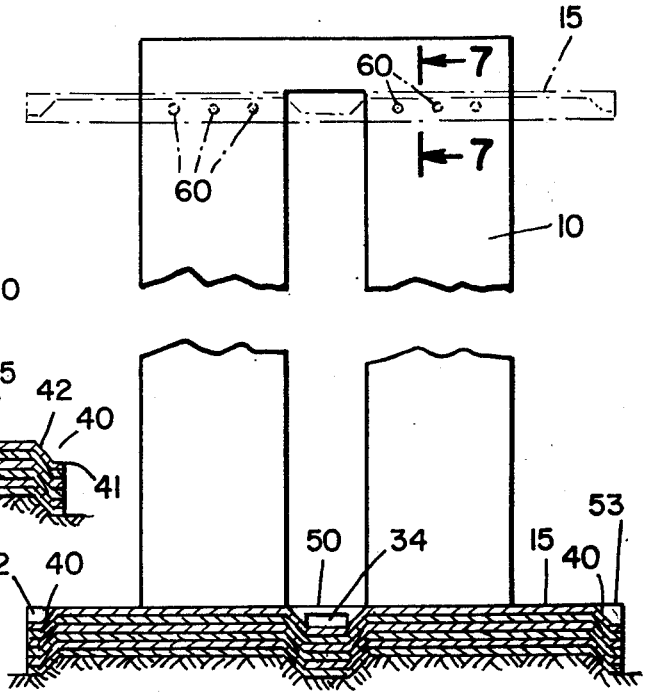
FIG. 4 is a view similar to that of FIG. 3 with the beams in place and illustrating one floor slab in phantom at its raised position.

When the first floor slab 15 is to be raised to its elevated position, a stiffening beam 50 is inserted in the central fold 34 running the length of the slab. Also, stiffening beams 52, 53 are placed in the folds 40 at the border of the floor slab. Corresponding beams are placed in the remaining folds in the slab. As illustrated in FIG. 4, such stiffening beams in the preferred embodiment of the present invention comprise reinforced concrete members. The stiffening beams can be poured in place concrete, precast concrete, or partially precast and partially poured in place. It is apparent that other stiffening members such as steel I-beams could also be used in the beam paths.

Figure 7:
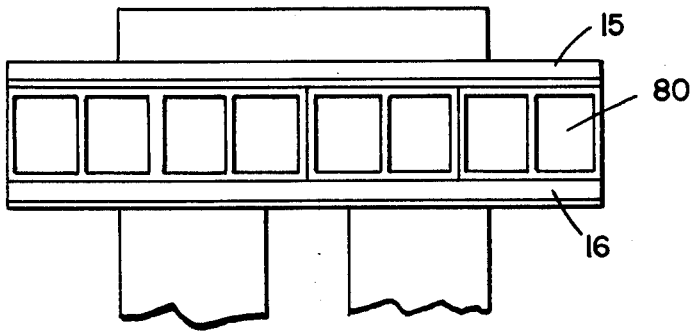
FIG. 7 is a cross sectional view taken along lines 7—7 of FIG. 4.
Figure 7:
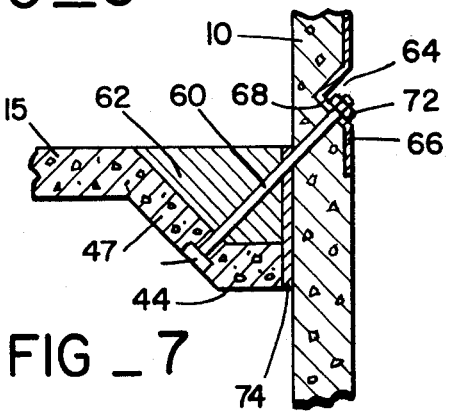

The uppermost floor slab 15 containing stiffening beams such as 50, 52 and 53 is elevated to its preselected raised position as illustrated in phantom at 15. In its raised position, floor slab 15 is connected to the sidewalls of the core towers such as core tower 10 on opposite sides of the slots by a plurality of bolts 60 as illustrated in more detail in FIG. 7. Each bolt 60 projects through the inclined portion 47 of fold 44 in floor slab 15, through a medial portion of a precast stiffening member 62 inserted in the fold and through the sidewall of core tower 10.

Complementary to each bolt 60 a cylindrical indentation 64 is formed in the inner surface of core tower 10, and a steel plate 66 is placed within the groove and conformed thereto. One surface 68 of steel plate 66 is parallel to the inclined portion 47 of fold 44.

Each series of bolts in each of the beams passes normally through the portion 68 of plate 66 and fold 47 in slab 15. A steel plate 70 is welded or otherwise engaged with one end of bolt 60 to secure it to floor slab 15, and the other end of bolt 60 is threadably engaged with nut 72 so that the bolt acts as a tension member to provide vertical support to floor slab 15. To further support the floor slab, grout 74 can be inserted between the floor slab 15, precast beam 62 and the sidewall of core tower 10.

It should be understood that three components of floor support are provided by the plurality of bolts 60 to each beam in each floor slab such as floor slab 15. First, the bolt provides a vertical component of support which prevents the floor from falling along the path it has been raised. Secondly, the bolt includes a horizontal component of support which presses the floor at its edge into the tower sidewalls. Thus, both the floor and the edge of the precast stiffening member 62 are compressed against the tower sidewalls at a concrete to concrete interface. This compression of the concrete to concrete interface together with the high static coefficient of concrete on concrete provides an additional force to support the floor.

Finally, it will be noted that the floors span outwardly — usually in a cantilevered fashion — from the edges of the tower sidewall. This cantilevering of the floor edges further compresses the floor at the tower sidewall against the tower sidewall. A further compression with a further static resistance of floor movement relative to the tower results.

Figure 5:
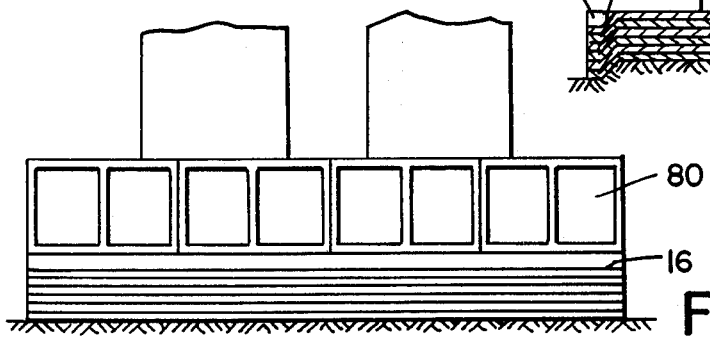
FIG. 5 is a fragmentary side elevation view of the installation of a curtain wall on one of the floor slabs.
Figure 6:
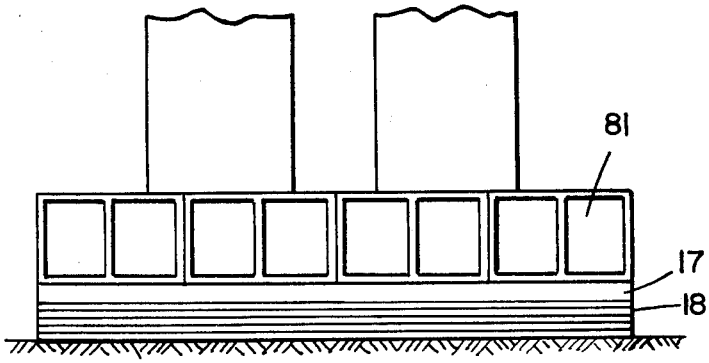
FIG. 6 is a side elevation of one of the floor slabs containing a curtain wall raised to its elevated position.

The uppermost slab such as 15 forms the roof of the building structure when it is raised to its elevated position. After floor slab 15 has been raised to its elevated position, stiffening beams are inserted in the folds of the next uppermost floor slab 16, as illustrated in FIG. 5. After insertion of the stiffening beams in slab 16, a curtain wall 80 can be erected on floor slab 16. Floor slab 16 is thereafter raised to its preselected elevated position as illustrated in FIG. 6 so that the upper edge of curtain wall 80 mates with the lower surface of floor slab 15. Stiffening beams are then added to the next uppermost floor slab 17 and a curtain wall 81 installed thereon. Floor slab 17 is thus ready to be raised into position, and stiffening beams and the curtain wall can thereafter be added to floor slab 18. The process is repeated until an entire building has been formed and all of the floor slabs are raised into their preselected elevated positions.

When each of the floor slabs has been raised into position, the floor slabs with their associated stiffening beams define not only the floors of the structure external to the core towers, but also lobby floors spanning the width of the towers themselves. Unimpeded shafts are provided on each side of the lobby floors within the core towers for the installation of elevator shafts, fire stair shafts, service shafts and the like.

The secondary portions of the floor slabs which span the slots in the core towers not only provide lobby floors, but also provide a path for a floor stiffening and reinforcing beam centrally located along the longitudinal axis of the building. Because of the central beam path, the central corridor of the building will have a depressed ceiling. Moreover, the ceiling at the borders will also be depressed because of folds 40. However, intermediate portions of the ceiling will be raised to allow for the convenient installation of heating, ventilation and airconditioning conduits emanating from the core tower. No intermediate stiffening beams are provided which would interfere with the placement of such conduits. The only position where such a conduit cannot be conveniently placed is along the center beam stiffener, but a central corridor is ordinarily located at this position, which corridor need not be heated or ventilated.

It is apparent that as the floor flabs are raised and fastened in position, structural loads will be imposed on the core towers so that they will tend to deflect inwardly or outwardly at the slots formed therein. However, each floor slab is attached to the sidewalls of the core towers on each side of the slot to resist such buckling and provide structural stiffness to the core towers. When all of the core towers have been raised into position, such structural stiffening will be provided along the entire height of the respective towers.

While a preferred embodiment of the present invention has been illustrated in detail, it is apparent that modifications and adaptations of that embodiment could occur to those skilled in the art. For example, it is not essential that two core towers be used, but rather one, three or any number of such towers may be employed. Furthermore, it may be desirable to form only a single slot in a core tower, and also it may be desirable to have secondary portions of the floor slab which do not fully span the core tower. However, it is to be expressly understood that such modifications and adaptations are within the spirit and scope of the present invention, as set forth in the following claims.

What is claimed is:

1. An improved method of constructing a building of multiple ground constructed hoisted and supported floors, said method comprising the steps of: constructing at least one tower having an interior hollow core, said tower defining in sidewalls of said tower paired, vertically extending slots on opposing sidewalls of said tower to define confronting C-shaped sections of said tower separated by said intervening slots there between, said slots extending from the base of said tower continuously towards the top of said tower to the intended elevation of the highest of said supported floors; constructing horizontal floor slabs at a position proximate the base of said tower, each said slab having a major portion immediately circumscribing the outer periphery of said tower and a secondary portion contiguous to the major portion bridging between the slots in said tower to define at least a portion of the floor interior of said tower and said secondary portion spanning the spatial interval of said slots to fully occupy the section of said slot at said floor; raising said constructed horizontal floor slab from its position proximate the base of said tower to its intended elevation on said tower whereby said major portion circumscribing the outer periphery of said tower prevents outward deflection of said tower to open said slots, and said secondary portion spanning the spatial interval of said slots prevents inward movement of said tower sidewalls to close said slots; and, fastening the raised floor slab to said tower adjacent the openings of said slot whereby said floor slab as fastened to said tower cross braces said tower at said slot to reinforce said tower and simultaneously to support said floor slab.

2. The method of claim 1 and wherein said floor slabs are constructed proximate the base of the tower and stacked one on another prior to raising any one of said floor slabs to its preselected elevated position.

3. The invention of claim 1 and wherein said constructing at least one horizontal floor slab includes the step of placing a longitudinally extending floor supporting beam for stiffening and supporting said floor slab and extending said beam to span between said major and secondary floor portions through said slot.

4. An improved building having multiple supported floors comprising: at least one tower having an interior hollow core; said tower defining in sidewalls of said towers paired vertically extending slots on opposing sidewalls of said tower to define confronting C-shaped sections of said tower separated by intervening slots there between, said slots extending from the base of said tower continuously towards the top of said tower to the intended elevation of the highest of said supported floors; a plurality of horizontal floor slabs having a major portion immediately circumscribing the outer periphery of said tower and a secondary portion contiguous to the major portion bridging between the slots in said tower to define at least a portion of the floor interior of said tower, said secondary portions spanning the spatial interval of each of said slots to occupy the section of said slots at said floor; said floor slab fastened to said tower sidewalls across said slot whereby said major portion of said floor slab circumscribing the outer periphery of said tower prevents the outward deflection of said tower to open said slots and said secondary portion spanning the spatial interval of said slot prevents inward movement of said tower sidewalls to close said slots; and, said floor slab as fastened to said tower across said slot cross braces said tower at said slot to reinforce said tower and simultaneously support said floor slab.

* * * * *